US006216859B1

(12) United States Patent
Manservigi et al.

(10) Patent No.: US 6,216,859 B1
(45) Date of Patent: Apr. 17, 2001

(54) LAYERED MATERIAL PACKET FOR TOBACCO PRODUCTS

(75) Inventors: Alberto Manservigi, Bologna; Fiorenzo Draghetti, Medicina, both of (IT)

(73) Assignee: G. D S.p.A., Bolgna (IT)

( * ) Notice: Subject to any disclaimer, the term of this patent is extended or adjusted under 35 U.S.C. 154(b) by 0 days.

(21) Appl. No.: 09/290,236

(22) Filed: Apr. 13, 1999

(30) Foreign Application Priority Data

Apr. 15, 1998 (IT) ..... BO98A0240

(51) Int. Cl.[7] ..... B65D 85/10; B65D 75/26

(52) U.S. Cl. ..... 206/268; 206/245; 206/274; 206/273; 229/87.13; 383/109

(58) Field of Search ..... 206/245, 268, 206/271, 274, 273, 275; 229/87.13, 87.14; 383/109

(56) References Cited

U.S. PATENT DOCUMENTS

| | | | | |
|---|---|---|---|---|
| 194,359 | * | 8/1877 | Mallalieu | 383/109 |
| 565,587 | * | 8/1896 | Arkell | 383/109 |
| 1,119,281 | * | 12/1914 | Hill | 206/245 |
| 1,935,612 | * | 11/1933 | Brady | 383/109 |
| 2,183,330 | * | 12/1939 | Drew | 206/279 X |
| 3,037,678 | * | 6/1962 | Caruso | 206/268 X |
| 3,078,029 | * | 2/1963 | Lacey | 206/268 |
| 4,293,068 | | 10/1981 | Focke et al. . | |
| 4,351,933 | * | 9/1982 | Barber et al. | 206/264 |

FOREIGN PATENT DOCUMENTS

| | | | | |
|---|---|---|---|---|
| 677720 | | 6/1991 | (CH) . | |
| 0209362 | | 1/1987 | (EP) . | |
| 405270 | * | 1/1934 | (GB) | 229/87.13 |
| 997210 | * | 7/1965 | (GB) | 229/87.13 |
| 2031849 | | 4/1980 | (GB) . | |
| 2038288 | | 7/1980 | (GB) . | |
| 2 263 774 | * | 7/1993 | (GB) | 229/87.13 |
| 2297966 | | 8/1996 | (GB) . | |

* cited by examiner

*Primary Examiner*—Bryon P. Gehman
(74) *Attorney, Agent, or Firm*—Pillsbury Winthrop LLP

(57) ABSTRACT

In a cigarette packet with an inner wrapping enveloping a group of cigarettes, and an outer wrapping folded around the inner wrapping, the outer wrapping is fashioned from a layered material consisting in a first inner layer of paper material and, bonded to the first layer, a second layer of exposed finish material different to the paper material of the inner layer.

18 Claims, 1 Drawing Sheet

LAYERED MATERIAL PACKET FOR TOBACCO PRODUCTS

BACKGROUND OF THE INVENTION

The present invention relates to a packet for tobacco products.

In particular, the present invention relates to both the soft type and the rigid type of packet used for tobacco products, typically cigarettes, cigars or the like, to which reference is made throughout the following specification albeit with no limitation in general scope implied.

Generally speaking, the soft or "crush" type of cigarette packet is substantially parallelepiped in appearance and comprises an inner wrapping, usually of paper or metal foil, fully enveloping a group of cigarettes and likewise presenting a substantially parallelepiped appearance with four side faces, a bottom face and a top face; packets of this type also comprise an outer wrapping or label fashioned from a sheet of material, generally paper, which is folded partially about the inner wrapping in such a way that the top face of this same inner wrapping remains exposed.

Similarly, packets of the rigid type with hinged lid appear substantially parallelepiped and consist essentially of a box-like outer wrapping fashioned from a precreased flat diecut blank, generally card or paperboard, also an inner wrapping generally of paper or metal foil located internally of the outer wrapping, fully enveloping the group of cigarettes and identical in shape to the inner wrapping of the soft type of. pack. The box-like external wrapping usually comprises a container of cupped appearance, also a lid, likewise of cupped appearance, hingedly associated with a rear top edge of the container and functioning as a closure.

In addition to containing the group of cigarettes and maintaining it correctly in position, the inner wrapping is intended conventionally to protect the cigarettes by preventing a rapid release of the tobacco aroma into the environment.

The need to preserve the tobacco aroma for as long as possible inside the packet is a pressing one, and particularly in the event that the tobacco has been treated beforehand with special, highly fragranced aromatic substances.

To make doubly sure the aroma will not be lost, packets are generally sealed inside a protective overwrapping of plastic material, e.g. Cellophane®, which combines with the inner wrapping to create a double barrier around the cigarettes and affords a tear-open ribbon with a pull tab.

Once the user has opened the plastic overwrapping by gripping the tab and pulling the ribbon to break the seal, and then torn or removed the part of the inner wrapping that gives access to the cigarettes, the additional measures mentioned above will become of limited use as the cigarettes are left effectively without suitable protection.

More precisely, with the protective action of the inner wrapping and overwrapping eliminated or at least attenuated to a degree, the outer wrapping is no longer able to provide an effective barrier and therefore to preserve the tobacco aroma, with the result that the essences and the original fragrance of the leaf are rapidly lost.

An object of the present invention is to provide a packet for tobacco products that will be capable of protecting the contents it envelops, and preserving the original aroma of the tobacco even after being opened.

A further object of the present invention is to fashion a packet for tobacco products, be it of the soft type or of the rigid type with a hinged lid, such as will exhibit a special and original visual appeal compared to conventional packets.

SUMMARY OF THE INVENTION

The stated objects are realized according to the present invention in a packet for tobacco products, of the type with an outer wrapping fashioned from a layered material comprising at least two layers of different material bonded one to another, of which a first layer disposed on the inside face of the wrapping consists of a paper backing material, and a second layer disposed on the outside face of the wrapping consists of an exposed finish material.

BRIEF DESCRIPTION OF THE DRAWINGS

The invention will now be described in detail, by way of example, with reference to the accompanying drawings in which.

DESCRIPTION OF THE PREFERRED EMBODIMENTS

Figure 1:
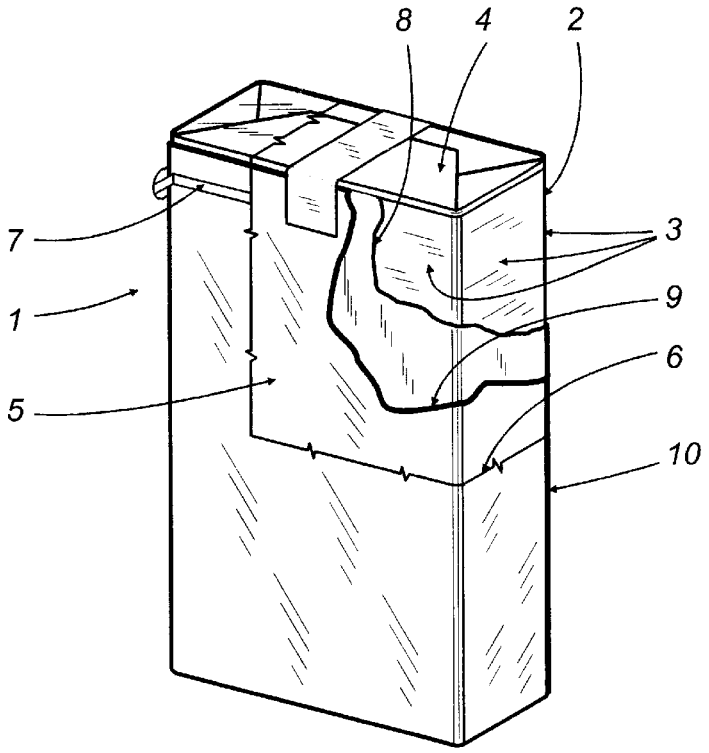
FIG. 1 illustrates a packet for tobacco products of the soft or "crush" type, viewed in perspective and with certain parts of the outer wrapping cut away better to show its embodiment in accordance with the present invention.
Figure 2:
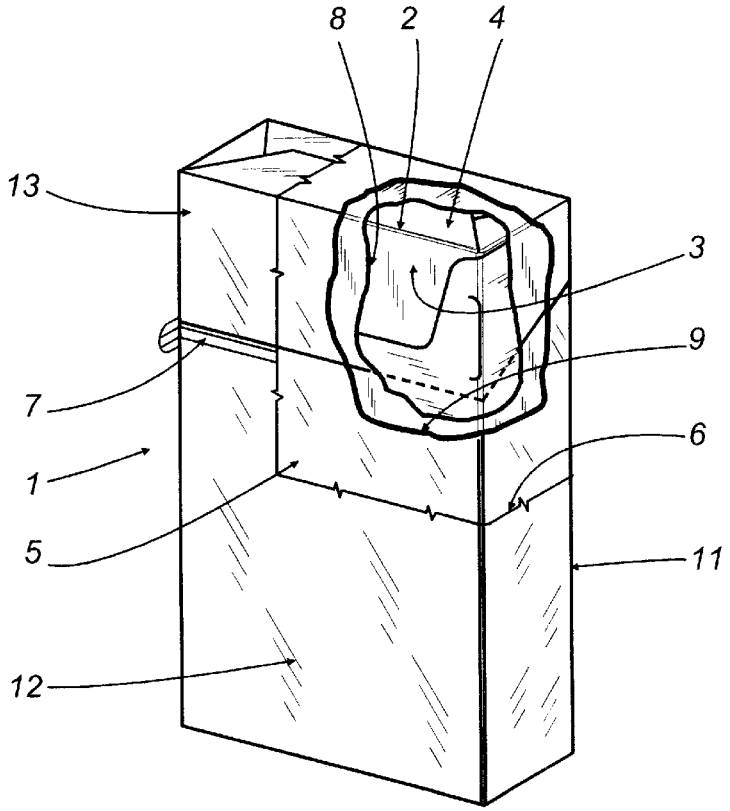
FIG. 2 illustrates a packet for tobacco products of the rigid type provided with a hinged lid, viewed in perspective and with certain parts of the outer wrapping cut away better to show its embodiment in accordance with the present invention.

Reference to FIGS. 1 and 2, a packet denoted 1 in its entirety is designed to accommodate a group of cigarettes (not indicated) enveloped completely by an inner wrapping 2 of conventional design, presenting a substantially parallelepiped geometry defined by four side faces 3, a bottom face (not indicated), and a top face 4.

The inner wrapping 2 of the packet 1 is enveloped by an outer wrapping 5, which in the two examples of FIG. 1 and FIG. 2 is itself substantially sealed within a protective overwrapping 6 of transparent plastic material incorporating a tear ribbon 7 of conventional type that is pulled to break the seal when opening the packet.

According to the invention, the outer wrapping 5 is fashioned from a layered material consisting of two layers 8 and 9 embodied in materials dissimilar to one another, which are bonded together.

In a finished packet 1, the outer wrapping 5 will comprise a first layer 8 of paper material breasted in contact with the inner wrapping 2 and referred to herein as an inner layer, which functions as the backing for a second layer 9 of finishing material referred to herein as an outer finish layer.

The second or outer finish layer 9 can be applied using any one of several different materials, for example fabric, such as a natural fabric of animal origin such as wool or silk, or of vegetable origin such as cotton or the like; similarly, a synthetic fabric could be used.

Alternatively, the outer finish layer 9 might be produced in a material referred to conventionally as non-woven fabric, that is to say a flat textile structure obtained by means other than weaving and consisting substantially of a tissue or layer of fibers bonded together mechanically, chemically or thermally.

The second or outer layer 9 might also consist of a thin layer of cork, wood or veneer, in which case it could be bonded to the inner layer 8 of backing paper by an adhesive process of conventional type such as will invest the layered material with a certain elasticity, making it extremely pliable and easily workable so that the outer wrapping 5 can be fashioned without difficulty.

In a further embodiment, the second or outer finish layer 9 could be of natural or synthetic leather.

In yet another embodiment, finally, the second or outer finish layer 9 could be of plastic material.

Interestingly, it has been verified by experiment that when the outer wrapping 5 is fashioned from a layered material comprising two layers 8 and 9 of dissimilar material bonded together, the one a backing Layer 8 of paper material and the other an outer layer 9 in one of the materials mentioned above, the outer wrapping 5 is able to protect the enveloped cigarettes, preserving the original aroma of the tobacco even after the packet 1 has been opened.

In the example of FIG. 1, which illustrates a soft or crush type of packet 1, the outer wrapping 5 consists in a label 10 fashioned from a sheet of layered material comprising an inner layer 8 of paper and an outer layer 9 in one of the finish materials described above; the label 10 is folded around the inner wrapping 2 in such a manner as to leave the top face 4 exposed. Given that the packet is of the soft type in this instance, at least the inner layer 8 of paper material will be relatively thin.

In the example of FIG. 2 which shows a packet 1 of rigid type with a hinged lid, the outer wrapping 5 consists in a container 12 of cupped appearance surmounted by a lid 13, also of cupped appearance, which is hinged to the container 12 and rotatable thus between the closed position shown in FIG. 2, and an open position (not illustrated).

The container 12 and the lid 13 are fabricated (in conventional manner, not illustrated) from a flat precreased diecut blank (likewise conventional and not illustrated) comprising an inner or backing layer 8 of paper and an outer layer 9 in a finish material as described above. Given that the packet is of the rigid type in this instance, at least the inner layer 8 of paper material will be somewhat thicker than the inner layer 8 used for the outer wrapping 5 of the soft packet 1.

It will be observed that the method of layering the outer wrapping of a cigarette packet described above might be adopted to advantage for rigid type packets different in design to the packet 1 with a hinged lid described and illustrated.

What is claimed is:

1. A packet for tobacco products comprising:

an outer wrapping fashioned from a layered material that includes at least two layers of different material bonded substantially throughout respective adjacent surface areas of the layers of material, of which a first layer disposed on the inside face of the wrapping is a paper material, and a second layer disposed on the outside face of the wrapping is a fabric material, the second layer constructed and arranged to retain an aroma of the tobacco products, wherein the outer wrapping is fabricated from a flat, pre-creased die-cut blank comprising the layered material and folded to form a substantially parallelepiped box, and to provide a bottom and four sides of the packet.

2. A packet as in claim 1, wherein the second layer disposed on the outside face of the wrapping is a natural fabric.

3. A packet as in claim 2, wherein the outer wrapping is enveloped by an overwrapping.

4. A packet as in claim 3, wherein the overwrapping incorporates a tear ribbon for ease of opening.

5. A packet as in claim 1, wherein the second layer disposed on the outside face of the wrapping is a synthetic fabric.

6. A packet as in claim 5, wherein the outer wrapping is enveloped by an overwrapping.

7. A packet as in claim 6, wherein the overwrapping incorporates a tear ribbon for ease of opening.

8. A packet as in claim 1, wherein the outer wrapping is enveloped by an overwrapping.

9. A packet as in claim 8, wherein the overwrapping incorporates a tear ribbon for ease of opening.

10. A packet for tobacco products comprising an outer wrapping fashioned from a layered material that includes at least two layers of different material bonded substantially throughout respective adjacent surface areas of the layers of material, of which a first layer disposed on the inside face of the wrapping consists of a paper material, and a second layer disposed on the outside face of the wrapping is a non-woven fabric material and is constructed and arranged to retain an aroma of the tobacco products, wherein the outer wrapping is fabricated from a flat, pre-creased die-cut blank comprising the layered material and folded to form a substantially parallelepiped box, and to provide a bottom and four sides of the packet.

11. A packet as in claim 10, wherein the outer wrapping is enveloped by an overwrapping.

12. A packet as in claim 11, wherein the overwrapping incorporates a tear ribbon for ease of opening.

13. A packet for tobacco products comprising an outer wrapping fashioned from a layered material that includes at least two layers of different material bonded substantially throughout respective adjacent surface areas of the layers of material, of which a first layer disposed on the inside face of the wrapping consists of a paper material, and a second layer disposed on the outside face of the wrapping is a leather material and is constructed and arranged to retain an aroma of the tobacco products wherein the outer wrapping is fabricated from a flat, pre-creased die-cut blank comprising the layered material and folded to form a substantially parallelepiped box, and to provide a bottom and four sides of the packet.

14. A packet as in claim 13, wherein the outer wrapping is enveloped by an overwrapping.

15. A packet as in claim 14, wherein the overwrapping incorporates a tear ribbon for ease of opening.

16. A packet for tobacco produces comprising an outer wrapping fashioned from a layered material that includes at least two layers of different material bonded substantially throughout respective adjacent surface areas of the layers of material, of which a first layer disposed on the inside face of the wrapping consists of a paper material, and a second layer disposed on the outside face of the wrapping is a synthetic leather material and is constructed and arranged to retain an aroma of the tobacco products wherein the outer wrapping is fabricated from a flat, pre-creased die-cut blank comprising the layered material and folded to form a substantially parallelepiped box, and to provide a bottom and four sides of the packet.

17. A packet as in claim 16, wherein the outer wrapping is enveloped by an overwrapping.

18. A packet as in claim 17, wherein the overwrapping incorporates a tear ribbon for ease of opening.

* * * * *